US006677090B1

(12) United States Patent
Tong et al.

(10) Patent No.: US 6,677,090 B1
(45) Date of Patent: Jan. 13, 2004

(54) IMAGING MEMBER

(75) Inventors: Yuhua Tong, Webster, NY (US); John F. Yanus, Webster, NY (US); Timothy J. Fuller, Pittsford, NY (US); Alexander N. Klymachyov, Rochester, NY (US); Min-Hong Fu, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/201,874

(22) Filed: Jul. 23, 2002

(51) Int. Cl.[7] ..... G03G 5/04
(52) U.S. Cl. ..... 430/58.75; 430/58.65
(58) Field of Search ..... 430/58.75, 58.65, 430/58.05

(56) References Cited

U.S. PATENT DOCUMENTS

| | | | | |
|---|---|---|---|---|
| 4,233,384 | A | 11/1980 | Turner et al. | 430/59 |
| 4,265,990 | A | 5/1981 | Stolka et al. | 430/59 |
| 4,299,897 | A | 11/1981 | Stolka et al. | 439/59 |
| 4,306,008 | A | 12/1981 | Pai et al. | 430/59 |
| 4,439,507 | A | 3/1984 | Pan et al. | 430/59 |
| 4,806,443 | A | 2/1989 | Yanus et al. | 430/56 |
| 6,361,913 | B1 * | 3/2002 | Pai et al. | 430/58.3 |
| 6,517,984 | B1 * | 2/2003 | Ferrar et al. | 430/58.2 |

* cited by examiner

*Primary Examiner*—John Goodrow

(57) ABSTRACT

A charge transport layer for an imaging member comprising a charge transport material with a single carbon cored dendrimeric, star-like molecular structure not exhibiting early onset of charge transport layer fatigue cracking. The charge transport layer exhibits excellent wear resistance, excellent electrical performance, and outstanding print quality.

11 Claims, No Drawings

IMAGING MEMBER

BACKGROUND

This invention relates in general to electrostatography and, more specifically, to an electrostatographic imaging member having a charge transport layer comprising a charge transport material containing a dendrimeric molecule structure

REFERENCES

In the art of electrophotography, an electrophotographic plate comprising a photoconductive insulating layer on a conductive layer is imaged by first uniformly electrostatically charging the surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles, for example from a developer composition, on the surface of the photoconductive insulating layer. The resulting visible toner image can be transferred to a suitable receiving member such as paper.

Electrophotographic imaging members are usually multilayered photoreceptors that comprise a substrate support, an electrically conductive layer, an optional charge blocking layer, an optional adhesive layer, a charge generating layer, a charge transport layer, and an optional protective or overcoating layer(s). The imaging members can take several forms, including flexible belts, rigid drums, etc. For many multilayered flexible photoreceptor belts, an anti-curl layer is usually employed on the backside of the substrate support, opposite to the side carrying the electrically active layers, to achieve the desired photoreceptor flatness.

Various combinations of materials for charge generating layers and charge transport layers have been investigated. U.S. Pat. No. 4,265,990 discloses a layered photoreceptor having a separate charge generating (photogenerating) layer (CGL) and charge transport layer (CTL). The charge generating layer is capable of photogenerating holes and injecting the photogenerated holes into the charge transport layer. The photogenerating layer utilized in multilayered photoreceptors include, for example, inorganic photoconductive particles or organic photoconductive particles dispersed in a film forming polymeric binder. Inorganic or organic photoconductive materials may be formed as a continuous, homogeneous photogenerating layer. The disclosure of this patent is incorporated herein by reference.

Examples of photosensitive members having at least two electrically operative layers including a charge generating layer and diamine containing transport layer are disclosed in U.S. Pat. Nos. 4,265,990, 4,233,384, 4,306,008, 4,299,897 and 4,439,507. The disclosures of these patents are incorporated herein in their entirety. Charge transport layers are known to be comprised of any of several different types of charge transport material dispersed in a polymer binder.

U.S. Pat. No. 4,806,443 describes a charge transport layer including a polyether carbonate (PEC) obtained from the condensation of N, N'-diphenyl N'-bis(3-hydroxyphenyl)-[1, 1'-biphenyl]-4,4'-diamine and diethylene glycol bischloroformate. U.S. Pat. No. 4,025,341 similarly describes that a photoreceptor includes a charge transport layer including any suitable hole transporting material such as poly (oxycarbonyloxy-2-methyl-1,4-phenylenecyclohexylidene-3-methyl-1,4-phenylene.

In multilayer photoreceptor devices, one property, for example, is the charge carrier mobility in the transport layer. Charge carrier mobility determines the velocities at which the photo-injected carriers transit the transport layer. For greater charge carrier mobility capabilities, for example, it may be necessary to increase the concentration of the active molecule transport compounds dissolved or molecularly dispersed in the binder. Phase separation or crystallization sets an upper limit to the concentration of the transport molecules that can be dispersed in a binder. What is still desired is an improved material for a charge transport layer of an imaging member that exhibits excellent performance properties and has a further advantage of not being susceptible to crystallization when present in the charge transport layer at a level of from about 30 weight percent or higher.

SUMMARY

Disclosed herein is an electrophotographic imaging member comprising a supporting substrate, a charge blocking layer, an optional adhesive layer, a charge-generating layer, a charge transporting layer, a binder, a charge transporting compound for use in a charge transport layer of an imaging member, and a charge transport layer material that is capable of not crystallizing at a weight percentage of from about 50 percent or higher.

Further disclosed is a charge transport material with a single carbon cored dendrimeric, star-like molecular structure that usually does not exhibit early onset of charge transport layer fatigue cracking. By the use of the disclosed dendrimeric materials in the charge transport layer of the present invention, a charge transport layer of an imaging member is achieved that has excellent hole transporting performance, less crystallization, and better wear resistance, and is able to be coated onto the imaging member structure using known conventional methods.

Aspects illustrated herein relate to an imaging member comprising, for example, a flexible supporting substrate, a charge blocking layer, an optional adhesive layer, a charge-generating layer, a charge transporting layer comprising an electron transport molecule with a single carbon cored dendrimeric, star-like molecular structure, and a binder.

The charge transport layer of a photoreceptor must be capable of supporting the injection of photo-generated holes and electrons from a charge generating layer and allowing the transport of these holes or electrons through the organic layer to selectively discharge the surface charge. If some of the charges are trapped inside the transport layer, the surface charges will not completely discharge and the toner image will not be fully developed on the surface of the photoreceptor.

The charge transport layer thus includes at least one charge transport material. For example, in embodiments, a charge transport molecule comprises a single carbon cored dendrimeric star-like compound represented by:

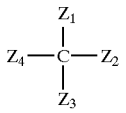

wherein $Z_{1-4}$ is independently selected from:

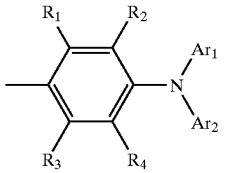

wherein $R_1$, $R_2$, $R_3$ and $R_4$ are independently selected from $-C_nH_{2n=1}$ wherein n is an integer from 0 to 6, $Ar_1$, and $Ar_2$ are independently selected from:

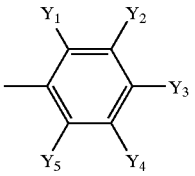

wherein $Y_1$ to $Y_5$ are independently selected from hydrogen, halogen, alkyl, alkoxy, thioalkoxy, cyano, amino, carboxylic acid, mono- or di-substituted amino, hydroxy, mercapto, aryloxy, arylthio, carbocyclic aromatic ring group and heterocyclic aromatic ring group.

Typical dendrimeric compounds are represented by:

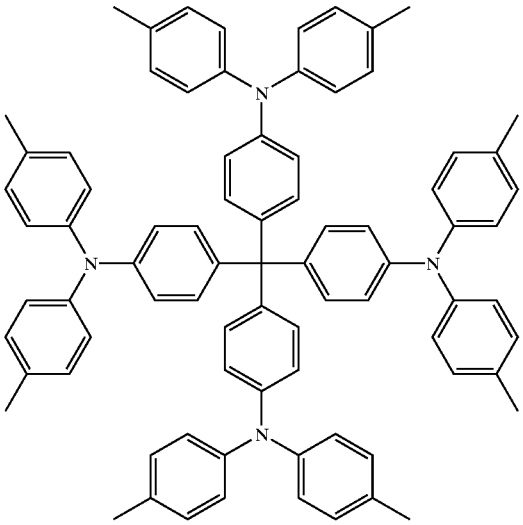

tetra-(4-(N,N′-di(4-methylphenyl)amino)phenyl)methane

-continued

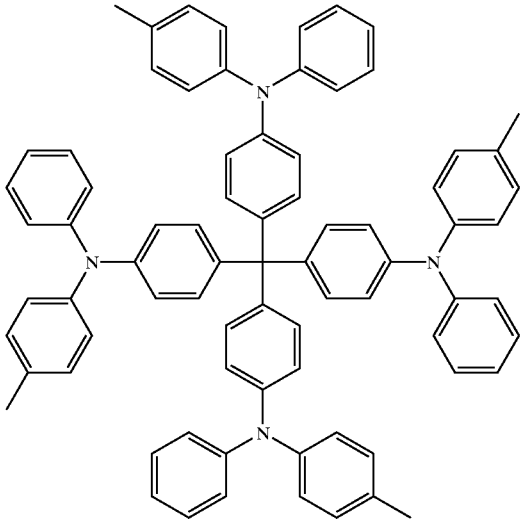

tetra-(4-((N-phenyl),N′-(4-methylphenyl)-amino)phenyl)methane

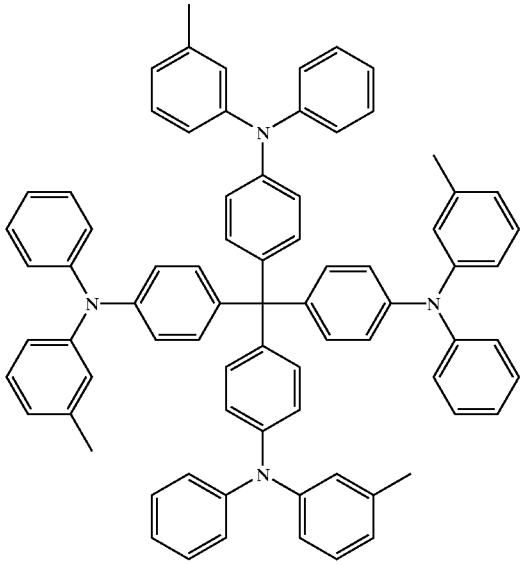

tetra-(4-((N-phenyl),N′-(3-methylphenyl)-amino)phenyl)methane

For example, in embodiments the charge transport layer comprises from about 20 to about 80 percent by weight of at least one charge transport material and about 80 to about 20 percent by weight of a polymer binder. The dried charge transport layer can contain from about 30 percent and about 70 percent by weight of a charge transport molecule based on the total weight of the dried charge transport layer.

The charge transport layer material may also include additional additives. Such as, for example, antioxidants, leveling agents, surfactants, wear resistant additives such as polytetrafluoroethylene (PTFE) particles, light shock resisting or reducing agents, and the like.

The solvent system can be included as a further component of the charge transport layer material. A number of conventional binder resins for charge transport layers have utilized methylene chloride as a solvent to form a coating solution, for example that renders the coating suitable for application via dip coating. However, methylene chloride has environmental concerns that usually require this solvent to have special handling and results in the need for more expensive coating and clean-up procedures. Currently, however, binder resins can be dissolved in a solvent system that is more environmentally friendly than methylene chloride, thereby enabling the charge transport layer to be formed less expensively than with some conventional polycarbonate binder resins. In embodiments a solvent system for use with the charge transport layer material of the present invention comprises tetrahydrofuran, toluene, and the like.

The total solid to total solvents of the coating material may for example, be around about 10:90 weight percent to about 30:70 weight percent, and in embodiments from about 15:85 weight percent to about 25:75 weight percent.

The following procedures and examples are provided to illustrate the preparation of the charge transport layer materials. It must be understood that these examples are intended to be illustrative only and that the invention is not intended to be limited to the materials, conditions, process parameters and the like recited herein.

EXAMPLE I

Synthesis of Tetra-(4-(N,N'-di(4-tolyl)Amino) Phenyl)Methane

In a 500-milliliter round bottomed flask equipped with mechanical stirrer and fitted with a Dean-Stark trap under a reflux condenser, tetra-iodophenyl methane (34.8 grams, 42.2 mmol), di-(4-tolyl)amine (38.3 grams, 194.2 mmol), copper powder (8.6 grams, 135.4 mmol), anhydrous potassium carbonate (46.7 grams; 337.6 mmol) and ISOPAR-M™ (100 milliliters were charged. The mixture was stirred and heated to 240 degrees Celsius under argon gas. The reaction was maintained at this temperature for 48 hours after which time chromatographic analysis revealed the reaction to be complete. The reaction mixture was cooled to 100 degrees Celsius, then toluene (250 milliliters) was added. This mixture was heated to a reflux temperature of 120 degrees Celsius for 3 hours. The non-soluble part was filtered off while the solution was still at 105 to 115 degrees Celsius. The filtrate was condensed to about 150 milliliters and was kept in a refrigerator. About 4 minutes later, there was observed slightly yellowish solids in the solution. The product was collected by filtration. The product was decolorized by dissolving it in 300 milliliters of toluene with 10 grams of FILTROL-24™ and 3 grams of decolorizing carbon black. After 2 hours stirring at reflux, the solution was hot filtered to remove the solids, and cooled to room temperature, about 22 to about 25 degrees Celsius. Evaporation of the solvent and recrystallization provided product about 33.0 grams.

EXAMPLE II

Formulation of Charge Transport Layer Materials

To form the charge transport layer material, 3.6 grams of the above charge transport material, 3.6 grams of poly(4,4'-diphenyl-1,1'-cyclohexane carbonate)-400, with a weight average molecular weight of 40,000, 22.5 grams of tetrahydrofuran and 7.5 grams of toluene were combined in a 60 milliliter-brown bottle. After mixing on a rolling mill at from about 20 to about 25 degrees Celsius for 15 hours, the solution was ready for coating.

The components may be added together in any suitable order, although the solvent system is in embodiments added to the vessel first. The transport molecule binder polymer may be dissolved together, although each is in embodiments dissolved separately and then combined with the solution in the vessel. Once all of the components of the charge transport layer material have been added to the vessel, the solution may be mixed to form a uniform coating composition.

The charge transport layer solution is applied to the photoreceptor structure. More in particular, the charge transport layer is formed upon a previously formed layer of the photoreceptor structure. In embodiments, the charge transport layer may be formed upon a charge generating layer. Any suitable and conventional techniques may be utilized to apply the charge transport layer coating solution to the photoreceptor structure. Typical application techniques include, for example, spraying, dip coating, extrusion coating, roll coating, wire wound rod coating, draw bar coating, and the like.

The dried charge transport layer has in embodiments a thickness of from about 5 to about 500 micrometers and more specifically has a thickness of, for example, from about 10 micrometers to about 50 micrometers. In general, the ratio of the thickness of the charge transport layer to the charge generating layer is in embodiments maintained from about 2:1 to about 200:1, and in some instances as great as about 400:1. The charge transport layer of the invention possesses excellent wear resistance.

Any suitable multilayer photoreceptor may be employed in the imaging member of this invention. The charge generating layer and charge transport layer as well as the other layers may be applied in any suitable order to produce either positive or negative charging photoreceptors. For example, the charge generating layer may be applied prior to the charge transport layer, as illustrated in U.S. Pat. No. 4,265,990, or the charge transport layer may be applied prior to the charge generating layer, as illustrated in U.S. Pat. No. 4,346,158, the entire disclosures of these patents being incorporated herein by reference. In embodiments, however, the charge transport layer is employed upon a charge generating layer, and the charge transport layer may optionally be overcoated with an overcoat and/or protective layer.

A photoreceptor of the invention employing the charge transport layer may comprise a substrate, a hole blocking layer, an optional adhesive layer, a charge generating layer, the charge transport layer, and one or more optional overcoat and/or protective layer(s).

The photoreceptor substrate may be opaque or substantially transparent, and may comprise any suitable organic or inorganic material having the requisite mechanical properties The substrate can be formulated entirely of an electrically conductive material, or it can be an insulating material including inorganic or organic polymeric materials, such as MYLAR® a commercially available polymer, MYLAR® coated titanium, a layer of an organic or inorganic material having a semiconductive surface layer, such as indium tin oxide, aluminum, titanium, and the like, or exclusively be made up of a conductive material such as aluminum, chromium, nickel, brass, and the like. The substrate may be flexible, seamless or rigid and may have a number of many different configurations, such as, for example, a plate, a drum, a scroll, an endless flexible belt, and the like. In one embodiment, the substrate is in the form of a seamless flexible belt. The back of the substrate, particularly when the substrate is a flexible organic polymeric material, may optionally be coated with a conventional anticurl layer having an electrically conductive surface. The thickness of the substrate layer depends on numerous factors, including mechanical performance and economic considerations. The thickness of this layer may range from about 65 micrometers to about 3,000 micrometers, and in embodiments from about 75 micrometers to about 1,000 micrometers for optimum flexibility and minimum induced surface bending stress when cycled around small diameter rollers, for example, 19 millimeter diameter rollers. The surface of the substrate layer is in embodiments cleaned prior to coating to promote greater adhesion of the deposited coating composition. Cleaning may be effected by, for example, exposing the surface of the substrate layer to plasma discharge, ion bombardment, and the like methods. Similarly, the substrate can be either is rigid or flexible. In embodiments, the thickness of this layer is from about 3 millimeters to about 10 millimeters. For flexible belt imaging members, for example, substrate thicknesses are from about 65 to about 150 microns, and in embodiments from about 75 to about 100 microns for optimum flexibility and minimum stretch when cycled around small diameter rollers of, for example, 19 millimeter diameter. The entire substrate can comprise the same material as that in the electrically conductive surface or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like.

The conductive layer of the substrate can vary in thickness over substantially wide ranges depending on the desired use of the electrophotoconductive member. Generally, the conductive layer ranges in thickness from about 50 Angstroms to many centimeters, although the thickness can be outside of this range. When a flexible electrophotographic imaging member is desired, the thickness of the conductive layer typically is from about 20 Angstroms to about 750 Angstroms, and in embodiments from about 100 to about 200 Angstroms for an optimum combination of electrical conductivity, flexibility, and light transmission. A hole blocking layer may then optionally be applied to the substrate. Generally, electron-blocking layers for positively charged photoreceptors allow the photogenerated holes in the charge generating layer at the surface of the photoreceptor to migrate toward the charge (hole) transport layer below and reach the bottom conductive layer during the electrophotographic imaging processes. Thus, an electron blocking layer is normally not expected to block holes in positively charged photoreceptors such as photoreceptors coated with a charge generating layer over a charge (hole) transport layer. For negatively charged photoreceptors, any suitable hole blocking layer capable of forming an electronic barrier to holes between the adjacent photoconductive layer and the underlying zirconium or titanium layer may be utilized. A hole blocking layer may comprise any suitable material. The charge blocking layer may include polymers such as polyvinylbutyral, epoxy resins, polyesters, polysiloxanes, polyamides, polyurethanes, and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, gamma-aminobutyl) methyl diethoxysilane, and $[H_2N(CH_2)_3]CH_3Si(OCH_3)_2$, (gamma-aminopropyl)-methyl diethoxysilane, as disclosed in U.S. Pat. Nos. 4,338,387, 4,286,033 and 4,291,110. Other suitable charge blocking layer polymer compositions are also described in U.S. Pat. No. 5,244,762. These include vinyl hydroxyl ester and vinyl hydroxy amide polymers wherein the hydroxyl groups have been partially modified to benzoate and acetate esters that modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988,597. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of the U.S. Patents are incorporated herein by reference in their entirety.

The blocking layer is continuous and may have a thickness of less than about 10 micrometers because greater thicknesses may lead to undesirably high residual voltage. In embodiments, a blocking layer of from about 0.005 micrometers to about 1.5 micrometers facilitates charge neutralization after the exposure step and optimum electrical performance is achieved. The blocking layer may be applied by any suitable conventional technique such as spraying, dip coating, draw bar coating, gravure coating, silk screening, air knife coating, reverse roll coating, vacuum deposition, chemical treatment, and the like. For convenience in obtaining thin layers, the blocking layer is, in embodiments, applied in the form of a dilute solution, with the solvent being removed after deposition of the coating by conventional techniques such as by vacuum, heating, and the like. Generally, a weight ratio of blocking layer material and solvent of between about 0.05:100 to about 5:100 is satisfactory for spray coating.

If desired an optional adhesive layer may be formed on the substrate. Any suitable solvent may be used to form an adhesive layer coating solution. Typical solvents include tetrahydrofuran, toluene, hexane, cyclohexane, cyclohexanone, methylene chloride, 1,1,2-trichloroethane, monochlorobenzene, and the like, and mixtures thereof. Any suitable technique may be utilized to apply the adhesive layer coating. Typical coating techniques include extrusion coating, gravure coating, spray coating, wire wound bar coating, and the like. The adhesive layer is applied directly to the charge blocking layer. Thus, the adhesive layer is in embodiments in direct contiguous contact with both the underlying charge blocking layer and the overlying charge generating layer to enhance adhesion bonding and to effect ground plane hole injection suppression. Drying of the deposited coating may be effected by any suitable conventional process such as oven drying, infrared radiation drying, air drying, and the like. The adhesive layer should be continuous. Satisfactory results are achieved when the adhesive layer has a thickness of from about 0.01 micrometers to about 2 micrometers after drying. In embodiments, the dried thickness is from about 0.03 micrometers to about 1 micrometer. At thicknesses of less than about 0.01 micrometers, the adhesion between the charge generating layer and the blocking layer is poor and delamination can occur when the photoreceptor belt is transported over small diameter supports such as rollers and curved skid plates. When the thickness of the adhesive layer is greater than about 2 micrometers, excessive residual charge buildup is observed during extended cycling. The components of the photogenerating layer comprise photogenerating particles for example, of Type V hydroxygallium phthalocyanine, x-polymorph metal free phthalocyanine, or chlorogallium phthalocyanine photogenerating pigments dispersed in a matrix comprising an arylamine hole transport molecules and certain selected electron transport molecules. Type V hydroxygallium phthalocyanine is well known and has X-ray powder diffraction (XRPD) peaks at, for example, Bragg angles (2 theta +/−0.20°) of 7.4, 9.8,12.4, 16.2, 17.6, 18.4, 21.9, 23.9, 25.0, 28.1, with the highest peak at 7.4degrees. The X-ray powder diffraction traces (XRPDs) were generated on a Philips X-Ray Powder Diffractometer Model 1710 using X-radiation of CuK-alpha wavelength (0.1542 nanometer). The Diffractometer was equipped with a graphite monochrometer and pulse-height discrimination system. Two-theta is the Bragg angle commonly referred to in x-ray crystallographic measurements. I (counts) represents the intensity of the diffraction as a function of Bragg angle as measured with a proportional counter. Type V hydroxygallium phthalocyanine may be prepared by hydrolyzing a gallium phthalocyanine precursor including dissolving the hydroxygallium phthalocyanine in a strong acid and then reprecipitating the resulting dissolved precursor in a basic aqueous media; removing any ionic species formed by washing with water; concentrating the resulting aqueous slurry comprising water and hydroxygallium phthalocyanine as a wet cake; removing water from the wet cake by drying; and subjecting the resulting dry pigment to mixing with a second solvent to form the Type V hydroxygallium phthalocyanine. These pigment particles in embodiments have an average particle size of less than about 5 micrometers.

The photogenerating layer containing photoconductive compositions and/or pigments and the resinous binder material generally ranges in thickness of from about 0.1 micrometers to about 5.0 micrometers, and in embodiments has a thickness of from about 0.3 micrometers to about 3 micrometers. Thicknesses outside of these ranges can be selected. The photogenerating layer thickness is generally related to binder content. Thus, for example, higher binder content compositions generally result in thicker layers for photogeneration.

Any suitable film forming binder may be utilized in the photoconductive insulating layer. Examples of suitable binders for the photoconductive materials include thermoplastic and thermosetting resins such as polycarbonates, polyesters, including polyethylene terephthalate, polyurethanes, polystyrenes, polybutadienes, polysulfones, polyarylethers, polyarylsulfones, polyethersulfones, polycarbonates, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly-N-vinylpyrrolidinone)s, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers may be block, random or alternating copolymers.

Specific electrically inactive binders include polycarbonate resins with a weight average molecular weight of from about 20,000 to about 100,000. In embodiments, a weight average molecular weight of from about 50,000 to about 100,000 is specifically selected. More specifically, excellent imaging results are achieved with poly(4,4'-diphenyl-1,1'-cyclohexane carbonate) polycarbonate; poly(4,4'-diphenyl-1,1'-cyclohexane carbonate-500, with a weight average molecular weight of 51,000; or poly(4,4'-diphenyl-1,1'-cyclohexane carbonate-400, with a weight average molecular weight of 40,000.

The thickness of the photogenerating binder layer may not be particularly critical. Layer thicknesses of from about 0.05 micrometers to about 100.0 micrometers may be satisfactory and in embodiments from about 0.05 micrometers to about 40.0 micrometers thick. The photogenerating binder layer containing photoconductive compositions and/or pigments, and the resinous binder material in embodiments, ranges in thickness of from about 0.1 micrometers to about 5.0 micrometers, and has an optimum thickness of from about 0.3 micrometers to about 3 micrometers for best light absorption and improved dark decay stability and mechanical properties.

When the photogenerating material is present in the binder material, the photogenerating composition or pigment may be present in the film forming polymer binder compositions in any suitable or desired amounts. For example, from about 10 percent by volume to about 60 percent by volume of the photogenerating pigment may be dispersed in from about 40 percent by volume to about 90 percent by volume of the film forming polymer binder composition, and in embodiments from about 20 percent by volume to about 30 percent by volume of the photogenerating pigment may be dispersed in about 70 percent by volume to about 80 percent by volume of the film forming polymer binder composition. Typically, the photoconductive material is present in the photogenerating layer in an amount of from about 5 to about 80 percent by weight, and in embodiments from about 25 to about 75 percent by weight, and the binder is present in an amount of from about 20 to about 95 percent by weight, and in embodiments from about 25 to about 75 percent by weight, although the relative amounts can be outside these ranges.

The photogenerating layer containing photoconductive compositions and the resinous binder material generally ranges in thickness from about 0.05 microns to about 10 microns or more, and in embodiments from about 0.1 microns to about 5 microns, and in more specific embodiments having a thickness of from about 0.3 microns to about 3 microns, although the thickness may be outside these ranges. The photogenerating layer thickness is related to the relative amounts of photogenerating compound and binder, with the photogenerating material often being present in amounts of from about 5 to about 100 percent by weight. Higher binder content compositions generally require thicker layers for photogeneration. Generally, it is desirable to provide this layer in a thickness sufficient to absorb about 90 percent or more of the incident radiation which is directed upon it in the imagewise or printing exposure step. The maximum thickness of this layer is dependent primarily upon factors such as mechanical considerations, the specific photogenerating compound selected, the thicknesses of the other layers, and whether a flexible photoconductive imaging member is desired. The photogenerating layer can be applied to underlying layers by any desired or suitable method. Any suitable technique may be utilized to mix and thereafter apply the photogenerating layer coating mixture. Typical application techniques include spraying, dip coating, roll coating, wire wound rod coating, and the like. Drying of the deposited coating may be effected by any suitable technique, such as oven drying, infrared radiation drying, air drying, and the like.

The charge transport layer may comprise any suitable transparent organic polymer or non-polymeric material capable of supporting the injection of photogenerated holes or electrons from the charge generating layer and allowing the transport of these holes or electrons through the organic layer to selectively discharge the surface charge. The charge transport layer not only serves to transport holes or electrons, but also protects the photoconductive layer from abrasion or chemical attack. The charge transport layer is normally transparent in a wavelength region in which the electrophotographic imaging member is to be used when exposure is effected therethrough to ensure that most of the incident radiation is utilized by the underlying charge generating layer. The charge transport layer should exhibit negligible charge generation, and discharge if any, when exposed to a wavelength of light useful in xerography, e.g., 4000 to 9000 Angstroms. When used with a transparent substrate, imagewise exposure or erase may be accomplished through the substrate with all light passing through the substrate. In this case, the charge transport material need not transmit light in the wavelength region of use if the charge generating layer is sandwiched between the substrate and the charge transport layer. The charge transport layer in conjunction with the charge generating layer is an insulator to the extent that an electrostatic charge placed on the charge transport layer is not conducted in the absence of illumination.

The charge transport layer should trap minimal charges either holes or electrons as the case may be passing through it. Charge transport layer materials are well known in the art.

The charge transport layer may comprise activating compounds or charge transport molecules dispersed in normally, electrically inactive film forming polymeric materials for making these materials electrically active. These charge transport molecules may be added to polymeric materials which are incapable of supporting the injection of photogenerated holes and incapable of allowing the transport of these holes.

Optionally, an overcoat layer and/or a protective layer can also be utilized to improve resistance of the photoreceptor to abrasion. In some cases, an anticurl back coating may be applied to the surface of the substrate opposite to that bearing the photoconductive layer to provide flatness and/or abrasion resistance where a web configuration photoreceptor is fabricated. These overcoating and anticurl back coating layers are well known in the art, and can comprise thermoplastic organic polymers or inorganic polymers that are electrically insulating or slightly semiconductive. Overcoatings are continuous and typically have a thickness of less than about 10 microns, although the thickness can be outside this range. The thickness of anticurl backing layers generally is sufficient to balance substantially the total forces of the layer or layers on the opposite side of the substrate layer. An example of an anticurl backing layer is described in U.S. Pat. No. 4,654,284, the disclosure of which is totally incorporated herein by reference. A thickness of from about 70 to about 160 microns is a typical range for flexible photoreceptors, although the thickness can be outside this range. An overcoat can have a thickness of at most 3 microns for insulating matrices and at most 6 microns for semiconductive matrices. The use of such an overcoat can still further increase the wear life of the photoreceptor, the overcoat having a wear rate of 2 to 4 microns per 100 kilocycles, or wear lives of from about 150 to about 300 kilocycles.

Layered photoreceptor devices were made by hand coating charge transport layers of the above formulation on plant coated charge generation layers of hydroxygallium phthalocyanine (OHGaPc) in poly(4,4'-diphenyl-1,1'-cyclohexane carbonate)-400, with a weight average molecular weight of 40,000. The device was oven dried at 100 degrees Celsius for 30 minutes. When scanned in a drum scanner, the charge transport was good, the residual voltage was less than 6 volts, and there was no residual voltage cycle up in 10 k cycles. This device had excellent electrical properties.

To test for crystallization, the fabricated device was heated at 140 degrees Celsius for 30 minutes. Control devices containing conventional materials exhibit marked crystallization. Using dendritic materials of the invention, no crystallization was observed using microscopic techniques.

The photoreceptor of the invention is utilized in an electrophotographic image forming member for use in an electrophotographic imaging process. As explained above, such image formation involves first uniformly electrostatically charging the photoreceptor, then exposing the charged photoreceptor to a pattern of activating electromagnetic radiation such as light, which selectively dissipates the charge in the illuminated areas of the photoreceptor while leaving behind an electrostatic latent image in the non-illuminated areas. This electrostatic latent image may then be developed at one or more developing stations to form a visible image by depositing finely divided electroscopic toner particles, for example from a developer composition, on the surface of the photoreceptor. The resulting visible toner image can be transferred to a suitable receiving member such as paper. The photoreceptor is then typically cleaned at a cleaning station prior to being re-charged for formation of subsequent images.

The photoreceptor of the present invention may be charged using any conventional charging apparatus, which may include, for example, an AC bias charging roll (BCR), see, for example, U.S. Pat. No. 5,613,173, incorporated herein by reference in its entirety. Charging may also be effected by other well known methods in the art if desired, for example utilizing a corotron, dicorotron, scorotron, pin charging device, and the like.

Although the invention has been described with reference to specific embodiments, it is not intended to be limited thereto. Rather, those having ordinary skill in the art will recognize that variations and modifications, including equivalents, substantial equivalents, similar equivalents, and the like may be made therein which are within the spirit of the invention and within the scope of the claims.

What is claimed is:

1. An imaging member comprising a supporting substrate, a charge blocking layer, a charge generating layer, a charge transport layer, a binder, wherein the charge transport layer comprises a single carbon cored dendrimeric star-like compound represented by:

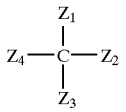

wherein $Z_{1-4}$ is independently selected from:

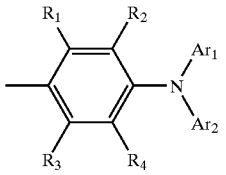

wherein $R_1$, $R_2$, $R_3$ and $R_4$ are independently selected from $-C_nH_{2n+1}$ wherein n is an integer from 0 to 6.

$Ar_1$ and $Ar_2$ are independently selected from:

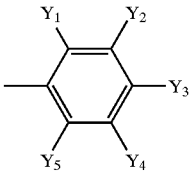

wherein $Y_1$ to $Y_5$ are selected independently from hydrogen, halogen, alkyl, alkoxy, thioalkoxy, cyano, amino, carboxylic acid, mono- or di-substituted amino, hydroxy, mercapto, aryloxy, arylthio, carbocyclic aromatic ring group and heterocyclic aromatic ring group.

2. An imaging member according to claim 1 wherein the charge transport layer is dispersed in a solvent comprising tetrahydrofuran and toluene.

3. An imaging member according to claim 1 wherein the charge transport layer comprises said binder in an amount of from about 20 to about 80 percent by weight.

4. An imaging member according to claim 1 wherein the binder is selected from the group consisting of polyesters, polyvinyl butyrals, polycarbonates, polystyrene-b-polyvinyl pyridine, poly(vinyl butyral), poly(vinyl carbazole), poly (vinyl chloride), polyacrylates, polymethacrylates, copolymers of vinyl chloride and vinyl acetate, phenoxy resins, polyurethanes, poly(vinyl alcohol), polyacrylonitrile, and polystyrene.

5. An imaging member according to claim 4 wherein the binder is a polycarbonate.

6. An imaging member according to claim 1 wherein the charge transport layer comprises a charge transport material in an amount of from about 20 to about 80 percent by weight.

7. An imaging member according to claim 1 further comprising an adhesive layer and an overcoat layer.

8. An image forming device comprising at least a photoreceptor and a charging device which charges the photoreceptor, wherein the photoreceptor comprises a substrate, a charge generating layer, a charge transport layer, and a binder, wherein the charge transport layer is selected from the group consisting of tetra-(4-(N,N'-di(4-toly)amino) phenyl)methane;

tetra-(4-(N,N'-di(4-methylphenyl)amino)phenyl) methane;

tetra-(4-((N-phenyl),N'-(4-methylphenyl)-amino)phenyl) methane; and tetra-(4-((N-phenyl),N'-(3-methylphenyl)-amino)phenyl) methane.

9. The image forming device according to claim 8 wherein the photoreceptor is in the form of a belt.

10. The image forming device according to claim 8 wherein the photoreceptor is in the form of a drum.

11. The image forming device according to claim 9 and further comprising a hole blocking layer, an adhesive layer, and an overcoat layer.

* * * * *